US007326116B2

(12) United States Patent
O'Donovan et al.

(10) Patent No.: US 7,326,116 B2
(45) Date of Patent: Feb. 5, 2008

(54) METHOD AND DEVICE IMPLEMENTING A PLAYER CONFIGURABLE GAMING MACHINE

(75) Inventors: John P. O'Donovan, Gallatin County, MT (US); Lee E. Cannon, Gallatin County, MT (US)

(73) Assignee: IGT, Reno, NV (US)

( * ) Notice: Subject to any disclaimer, the term of this patent is extended or adjusted under 35 U.S.C. 154(b) by 274 days.

(21) Appl. No.: 10/865,340

(22) Filed: Jun. 10, 2004

(65) Prior Publication Data

US 2004/0224753 A1 Nov. 11, 2004

Related U.S. Application Data

(63) Continuation of application No. 10/455,582, filed on May 27, 2003, now abandoned, which is a continuation of application No. 09/666,993, filed on Sep. 21, 2000, now abandoned.

(60) Provisional application No. 60/155,436, filed on Sep. 22, 1999.

(51) Int. Cl.
*A63F 9/24* (2006.01)

(52) U.S. Cl. ..... 463/29; 463/20; 463/43

(58) Field of Classification Search ..... 463/16–25, 463/29, 40–43, 37

See application file for complete search history.

(56) References Cited

U.S. PATENT DOCUMENTS

| | | | | |
|---|---|---|---|---|
| 5,277,424 | A | 1/1994 | Wilms | |
| 5,356,144 | A | 10/1994 | Fitzpatrick et al. | 273/148 R |
| 5,575,717 | A | 11/1996 | Houriet et al. | 273/148 B |
| 5,871,398 | A | 2/1999 | Schneier et al. | 463/16 |
| 6,068,552 | A * | 5/2000 | Walker et al. | 463/21 |
| 6,110,041 | A | 8/2000 | Walker et al. | 463/20 |
| 6,293,866 | B1 | 9/2001 | Walker et al. | 463/20 |
| 6,350,199 | B1 | 2/2002 | Williams et al. | 463/16 |

FOREIGN PATENT DOCUMENTS

WO WO 01/74464 10/2001

OTHER PUBLICATIONS

Megatouch touchreen Games owners manual, Merrti Industries Inc. 1994.*

* cited by examiner

*Primary Examiner*—Ronald Laneau
*Assistant Examiner*—Travis R. Banta
(74) *Attorney, Agent, or Firm*—Beyer Weaver LLP

(57) ABSTRACT

A player configurable video gaming machine in which a player may select one or more configuration inputs to play a previously configured default game or to create a new game configuration. Additionally, each game configuration may be saved to be implemented in various gaming machines.

15 Claims, 5 Drawing Sheets

METHOD AND DEVICE IMPLEMENTING A PLAYER CONFIGURABLE GAMING MACHINE

This application is a continuation of U.S. application Ser. No. 10/445,582, filed May 27, 2003 now abandoned, which is a continuation of U.S. application Ser. No. 09/666,993, filed Sep. 21, 2000 now abandoned, which claims the benefit of U.S. Provisional Application Ser. No. 60/155,436, filed Sep. 22, 1999, all of which are incorporated herein by reference in their entirety.

BACKGROUND

In general, this invention relates to a method for implementing a player configurable video gaming machine and in particular, to a menu driven player configurable video gaming machine that allows a player to make cosmetic and substantive chances to a video game while maintaining pre-set gaming machine pay tables.

Video gaming machines have become an integral part of the gaming industry. Typically, a gaming establishment offers players a wide variety of video gaming machines having different gaming configurations, game themes and game features. For example, to increase player excitement, some prior art video gaming machines increase the number of typical potential winning combinations to produce a larger frequency of lower winning amounts. Other prior art gaming machines offer fewer potential winning combinations while providing higher winning amounts for the player who is willing to wait for a bigger win. These configurations are then implemented in a variety of game themes and with a variety of features such as multiple pay lines or bonus games.

As often occurs in gaming establishments, players develop a preference for a particular configuration of gaming machines, game themes, and game features. However, the prior art video gaming machines implementing the combination of configuration, themes and features typically limited these settings in which they are pre-set. Thus to satisfy multiple requests for popular and/or different user requests, a gaming establishment must offer the players multiple gaming machines implementing a variety of configuration combinations.

As player interest changes, gaming establishments must consistently survey player usage and change the mix of video gaming machines as game theme and configuration preferences increase or decrease. Furthermore, player preference may also change during a gaming session. For example, in the prior art, a player wishing to continue gaming with a particular game theme, but wishing to change the configuration such as increasing the bet denomination or winning amounts, would have to seek a new video gaming machine. Often, if the other gaming machine is not easily accessible, the player may lose interest and discontinue gaming.

Some prior art gaming machines have attempted to incorporate partial user modification to the game. One such prior art method is disclosed in U.S. Pat. No. 5,277,424 to Alfred Wilms entitled VIDEO GAMING DEVICE UTILIZING PLAYER-ACTIVATED VARIABLE BETTING. The Wilms patent discloses a video card gaming machine in which a player is allowed to insert different denomination coins into the machine to vary the wager and simulate table gaming. However, the Wilms patent does not disclose allowing a player to adjust multiple configurations within the video card gaming machine, and is limited to allowing the player to vary only the wager amount. Thus, the Wilms patent does not resolve the issue of varying the configuration of other non-card based video games to satisfy user demand.

It is therefore desirable to provide a gaming machine in which a player may configure a video gaming machine by inputting one or more game configurations.

SUMMARY

Based on the above-noted deficiencies in the prior art, it is an object of the present invention to provide a video gaming machine in which a player may select one or more game configurations on the game.

This and other objects of the present invention are implemented in a video gaming machine providing an option menu allowing a player to configure a particular game on the gaming machine. A user initiates the video gaming machine by inserting a credit access device into the gaming machine. Upon initiating the game, the player is prompted to either begin playing a previously configured game or to create a new game. To create a new game, the system prompts the player with a menu to select various configurations of a video game. After completing the input process, the gaming machine most closely matches the desired configuration combinations with various default game configurations preprogrammed into the computer. The player can accept the default game suggested by the gaming machine, or the gaming machine will configure a new game by altering a default setting to the specific configuration criteria inputted by the player.

In the event a new game is configured, the gaming machine must relatively maintain a pre-set pay table for the gaming machine. Accordingly, the gaming machine logic determines whether the inputted configuration modification will substantially impact the gaming machine pay table. If a modification impacts the return, the gaming machine adjusts other configurations within the game to maintain the pay table. Other player inputs are of a cosmetic nature and are implemented by the gaming machine without the need to modify other configuration criteria

BRIEF DESCRIPTION OF THE DRAWINGS

The objects and features of the invention noted above are explained in more detail with reference to the drawings, in which like reference numerals denote like elements, and in which.

DETAILED DESCRIPTION OF VARIOUS EMBODIMENTS

Figure 1:
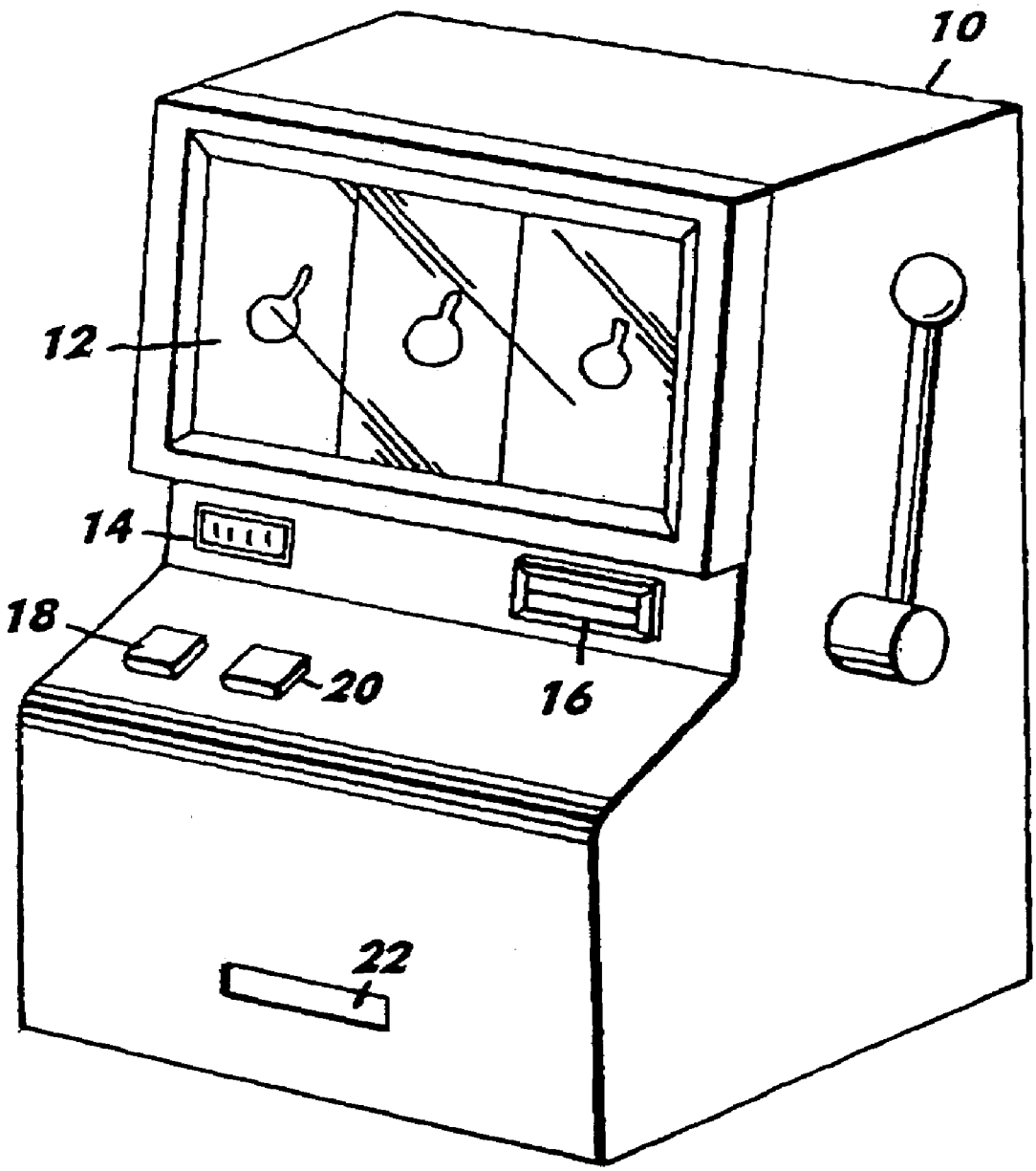
FIG. 1 is a representative of a gaming machine of the present invention.

The present invention relates to a method and device for implementing a menu driven player configurable video game 1. FIG. 1 denotes a representative video gaming machine, denoted generally by the reference numeral 10. Gaming machine 10 includes video display 12, credit display 14, input 16, buttons 18 and 20, and output 22. As would be understood by someone skilled in the relevant art, gaming machine 10 can be implemented as a stand alone gaming machine or as one of a plurality of gaming machines controlled via a central processing system. Furthermore, gaming machine 10 can include a variety of features, such as inputs (i.e., magnetic card reader, gaming coupon reader, currency acceptor), outputs (i.e., bar code printers and coin hoppers), and other variations of video gaming machines. All are considered within the scope of the present invention.

Figure 2:
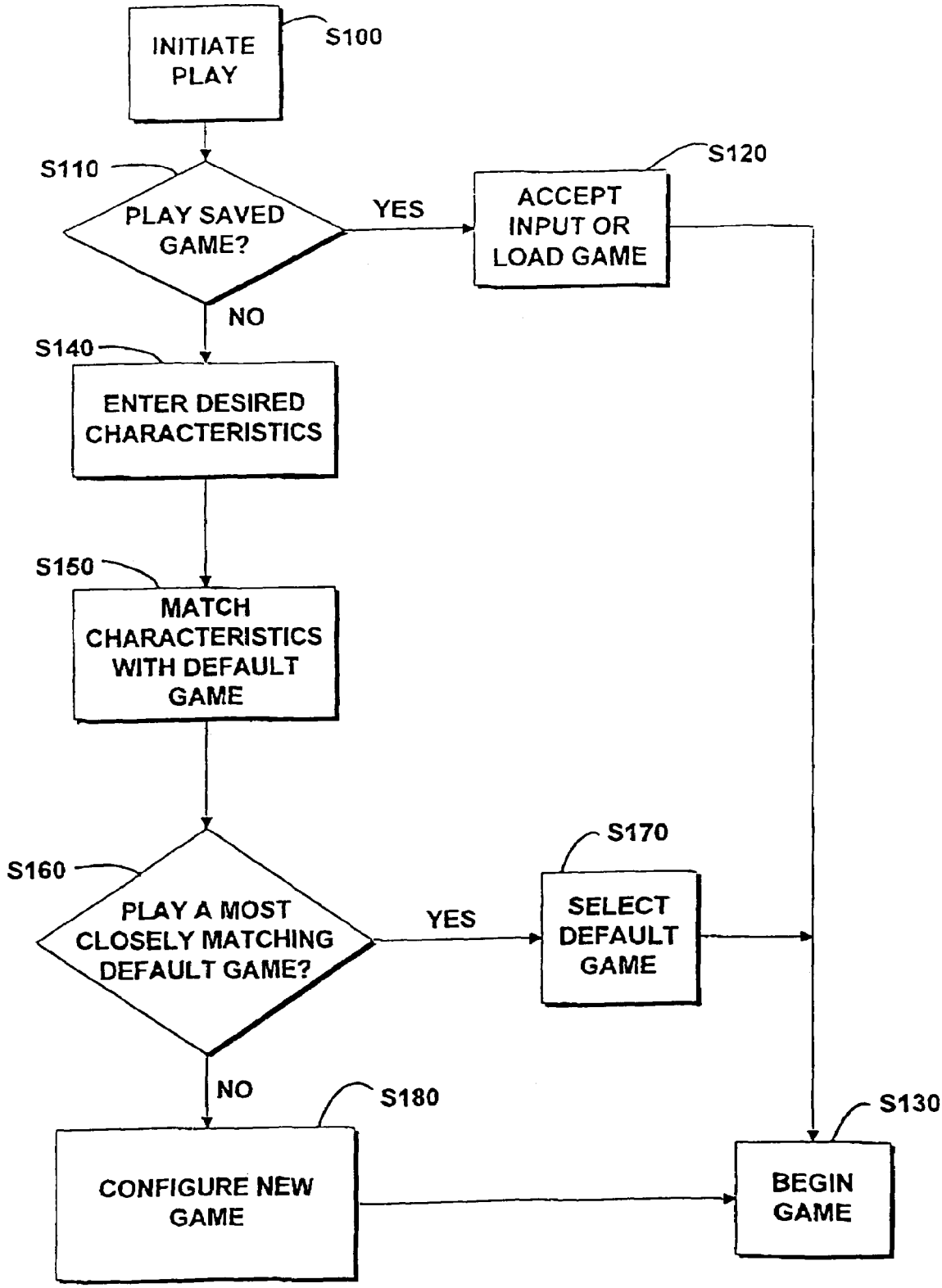
FIG. 2 is flow diagram of a preferred method implemented by the player configurable gaming machine of the present invention.

FIG. 2 is flow diagram of a preferred method implemented by the player configurable gaming machine of the present invention. At Step S100, a player initiates the video gaming machine by inserting credit access devices such as currency, gaining coupons, or magnetic cards. The player may also be prompted to insert player tracking devices such as magnetic cards or smart cards. At Step S110, the player is prompted with the option of loading a previously configured game. At Step S120, the player would be allotted to insert memory storage devices, such as computer disks, magnetic media, smart cards, CD-ROMS, and DVD, into the gaming machine to read the configuration data. Alternatively, the gaming establishment may also provide memory storage space to some or all players, such that they can recall previously saved programs without having to insert any memory storage devices. This memory storage space may be limited to a single machine, a group of machines, or the entire group of gaming machines within the gaming establishment. Having accessed a saved configuration, the player game would begin at Step S130.

Figure 3:
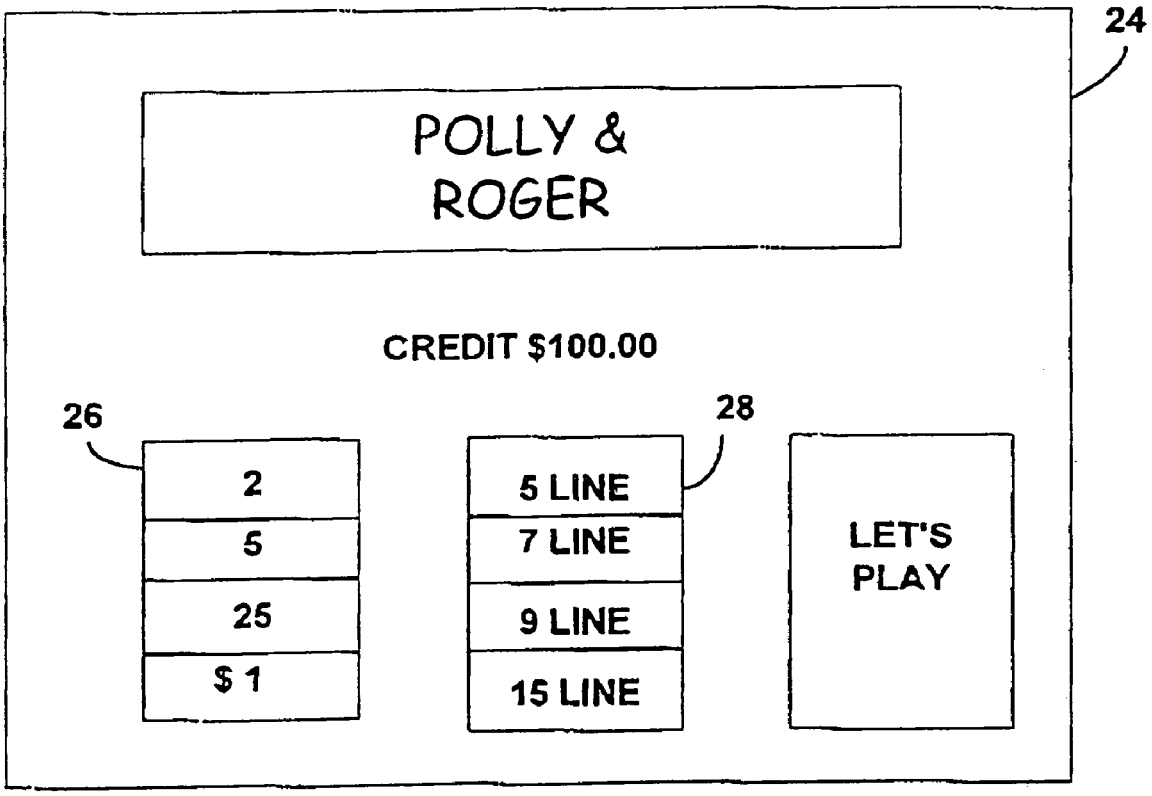
FIG. 3 is representative of a video display screen utilized by the player configurable gaming machine of the present invention.

If the player does not choose to load a saved configuration or does not have a previously saved configuration at Step S110, gaming machine prompts the player to input various configuration criteria at Step S140. Preferably, the player is prompted to enter the various criteria via a display screen menu or a series of menus. FIG. 3 is a representative of a preferred display screen 24 prompting a player to enter in desired game characteristics. In this display screen, the user is selecting the wagering denomination 26 and the number of pay lines 28. As would be understood, other configuration characteristics would include, but not be limited to, frequency of payout, size of jackpots, game theme, bonus games, and play speed and would be considered within the scope of the present invention.

Additionally, the gaming establishment may limit the number of characteristics a player may alter or require the player to enter in a minimum number of characteristics. For example, if a player wishes to change the frequency of winning combinations, the gaming establishment can maintain the machines pay table by programming the game machine 10 to prevent the size of the award from being adjusted by the player.

After inputting, the desired or necessary characteristics at Step S140, the gaming machine most closely matches the inputted desired characteristics with previously configured default games stored in memory at Step S150. Depending on the configuration parameters set by the gaming establishment, each gaming machine may store one or more default gaming configurations in memory. Alternatively, a central processing system may store the default configuration and download matching configurations to an individual gaming machine.

After the gaming machine matches or closely matches a default configuration, it asks the player to play the default configuration at Step S160. If the player accepts the default configuration at Step S170 splay begins at Step S830. If the player does not accept the most closely matching default configurations, the gaming machine configures one or more new games with the desired characteristics at Step S180 and the user beings play at Step S130.

To configure the new game at Step S180, gaming machine preferably identifies and groups the inputted configuration criteria into filtering configuration changes, substantive configuration changes, and cosmetic configuration changes. Filtering configuration changes are changes that require the system to select a default configuration most closely associate with the inputted criteria and do not require a change to a game configuration. One example of a filtering configuration change is bet denomination. If a player selects a specific bet denomination, gaming machine selects a version of a game whose pay table has been pre-configured for the specific denomination selected by the player (i.e. higher denomination bets have a higher payback percentage). Alternatively, if the pay table is not pre-configured to have varying payback percentages for varying bet denominations, the gaming machine may maintain the same payback percentage for all sizes of betting denominations.

In contrast, substantive configuration changes include game configurations that would alter the pay table of the machine. Such substantive changes may include changing the prize profile of the game (i.e., frequent small wins, less frequent large rains). To implement a substantive configuration change gaming machine modifies a default game configuration by changing the selected configuration criteria. However, because substantive configuration changes would affect the pay table of the game, the gaming machine adjusts other parameters to maintain a predefined pay table and payback percentage. For example, if the player input adjusts the win frequency of one category within the game, the gaming machine maintains the pay table by decreasing the win frequency in another category. Preferably, the player is allowed to change several characteristics such as win frequency and size of award in a single category. As would be understood, categories include one or more winning combinations and payout opportunities available in the gaming device. For example, a winning combination may include hitting five plumbs on a slot machine type game. Because win frequency and size of award could be considered substantive configuration changes, gaming machine 10 would preferably compensate for the changes by adjusting the combination of win frequencies and award amounts in another category.

Finally, cosmetic changes can be implemented by gaming machine 10 without altering the pay table. Such cosmetic changes include game theme, type of bonus feature, play speed and number of pay lines. Because these characteristics generally do not affect the pay table of the machine, gaming machine loads default games with the desired substantive configuration and implements the inputted desired cosmetic chances. As would be understood, player may input both substantive and cosmetic changes.

As would be understood, depending on the specific implementation of the gaming machine, some configuration characteristics could be classified differently. For example prize profiles may be considered a filtering chance if there are pre-existing default games closely matching inputted prize profile. All are considered within the scope of the present invention.

Figure 4A:
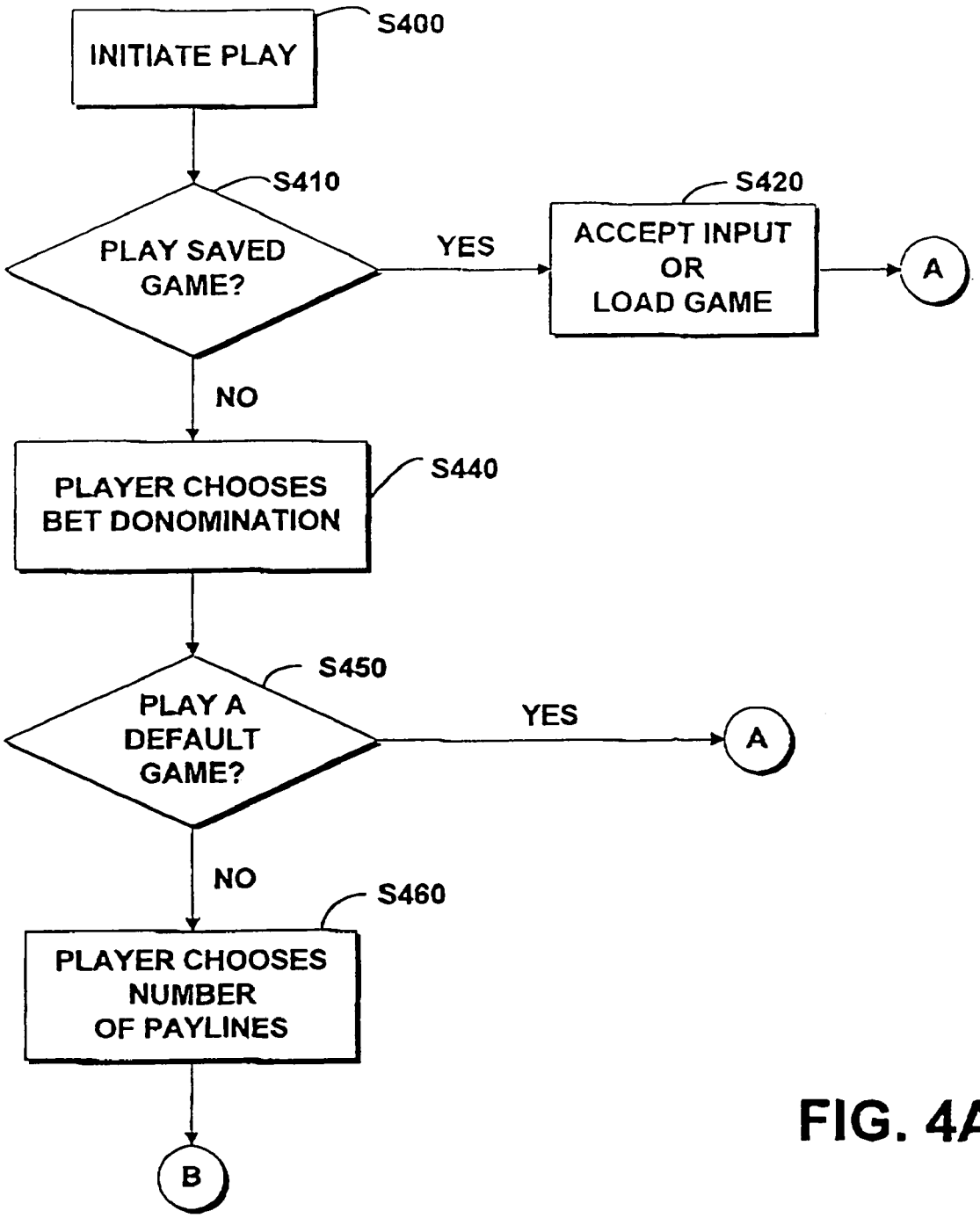
FIG. 4 is a flow diagram of a method implemented by the player configurable gaming machine of the present invention.
Figure 4B:
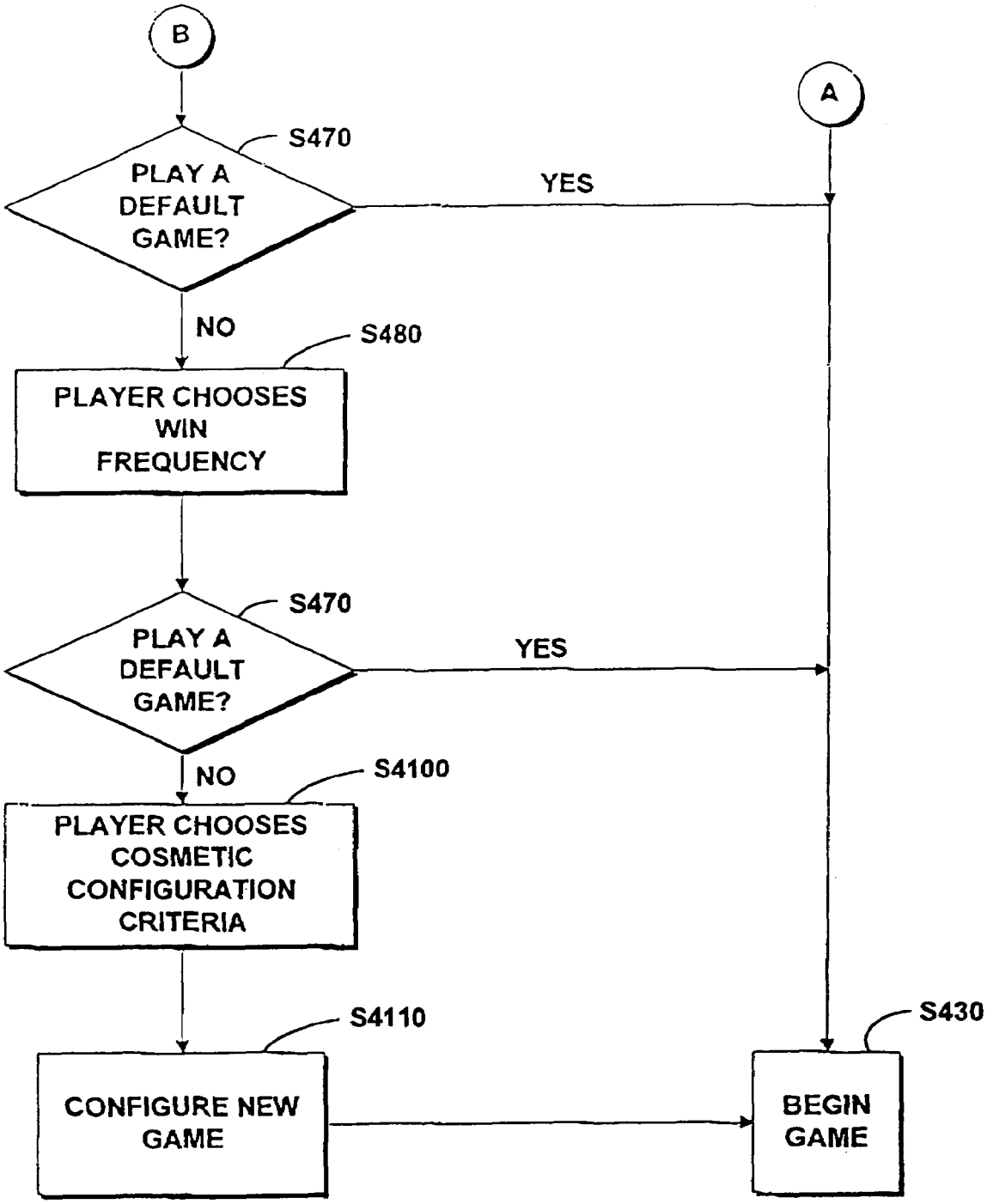

FIG. 4 denotes a flow diagram of an alternative embodiment of the method implemented by the gaming machine of the present invention. At Step S400, a player initiates the video gaming machine by inserting credit access devices such as currency, gaming coupons, or magnetic cards. As in the other method, this step includes the insertion of a variety of credit input, as well as player tracking devices. At Step S410, the player has the option of loading a previously configured game. If the player selects to play a saved game, the game is loaded at Step S420 and the play begins at Step S430. Similar to the previous embodiment, there are multiple ways of loading a previously saved configuration.

If the player does not choose to load a saved configuration or does not have a saved configuration at Step S410, the gaming machine enters into a cascading configuration selection sequence at Step S440 through Step S4110. At Step S440, the player first chooses a bet denomination or changes a default denomination. After the plainer selects a denomination, the gaming machine matches a default game(s) which has a matching or closely matching configuration characteristic and prompts the player whether they want to play the default game at Step S450. If the player chooses the default game, play begins at Step S430.

If, at Step S450 the player does not choose a default game, the gaming machine prompts the player to choose the number of pay lines at Step S460. After the player selects the number of pay lines the gaming machine most closely matches the default game(s) that have the characteristics and prompts the player to play the default games at Step S470. If the player chooses a default game, play begins at Step S430. As would be understood, in this embodiment, the gaming machine considers the characteristics as cumulative and most closely matches the default game having both characteristics. Alternatively, gaming machine 10 could also match default games having either characteristic.

If, at Step S470, the player does not choose the default game, the gaming machine prompts the player to choose the win frequency at Step S480. After the player selects the win frequency, the gaming machine most closely matches the default game(s) that have the characteristics and prompts the player to play the default games at Step S490. If the player chooses a default game, play begins at Step S430. As would be understood, the gaming machine preferably most closely matches the default game having all the inputted characteristics. Alternatively, the gaming machine could also match default games having any combination of the inputted characteristics.

If, at Step S490, the player does not select a default game, the gaming machine prompts the player to choose various cosmetic configurations at Step S4100. In the preferred embodiment, cosmetic configurations include game theme, bonus feature, and play speed. As would be understood, additional, less or different ordered game configurations in the cascading sequence would be considered within the scope of the present invention. Once the player selects the cosmetic configurations, the gaming machine configures the inputted characteristics with a pre-set gaming machine pay table at Step S4110. The player then begins play at Step S430.

Regardless of whether the player configuration is implemented under the method of FIG. 2 or the method of FIG. 4, the player may have the option saving the configuration once it is entered by the user. The saving option can occur anytime after the player has configured the game including before starting play, during the play and after completing play of the game. Additionally, the gaming machine may also automatically save the configuration for players that inserted player tracking cards. Configuration saving may occur directly in the memory of the gaming machine, in memory of the central processing system, or in a portable magnetic storage medium, such as a computer disk or a smart card. As would be understood, some gaming machines may not incorporate some or all of the game saving features.

In an effort to allow players to customize their configurations, an additional feature of the present invention allows the player to set up the gaming machine configuration on a computing device (such as a PC) and presave the configuration prior to entering the gaming establishment. Such off-line creation could include machines that can simulate the resulting game configurations and machines which only can accept inputted criteria without simulating the resulting game.

As another additional feature to the present invention, gaming establishments may also utilize player tracking devices to assist in choosing the suggested default games offered to the player. In an embodiment, the gaming machine would keep a record of game theme combinations the player has a history of playing and would suggest a default game most closely matching both the inputted criteria and the player's personal history.

As a further feature of the invention, gaming establishments may also track player preferences and configure the game when the player enters an identification card without any need to prompt the player to select configuration criteria. Under this embodiment, the gaming machine detects a specific player by various player tracking devices and configures the machine according to the preprogrammed criteria. Thus, a player would find his or her "favorite" machine regardless of which specific gaming machine was selected.

All embodiments of this present invention have been directed toward player configurations. Alternatively, the present invention could also be utilized by the gaming establishments to configure video gaming machines. In an embodiment, the gaming establishment would input some or all of the game configurations in lieu of the player input. This would allow gaming establishments to design their own games and to allow a video gaming machine to implement various configurations according to gaming establishment control. For example, a gaming machine may be configured to run high frequency low payout wins during the day and be reconfigured to give more lucrative, less frequent wins in the evenings. As would be understood, the gaming establishments may also implement partial control in which a player is allowed to change a limited number of game configurations.

The invention is considered to have been described in such full, clear, concise and exact terms as to enable a person of ordinary skill in the art to make and use the same. It will be apparent to those skilled in the art, that a person understanding this invention may conceive of changes or other embodiments or variations, which utilize the principles of this invention without departing from the broader spirit and scope of the invention as set forth in the appended claims. All are considered within the sphere, spirit and scope of the invention. The specification and drawings are, therefore, to be regarded in an illustrative rather than restrictive sense. Accordingly, it is not intended that the invention be limited except as may be necessary in view of the appended claims or their equivalents, which particularly point out and distinctly claim the subject matter applicant regards as its invention.

What is claimed is:

1. A method for providing and selecting a pre-configured game on a gaming machine, the method comprising:

providing a plurality of default games of different types in a memory device accessible to the gaming machine, each default game having pre-configured game parameters defining a default configuration of the default game, the pre-configured game parameters stored in a memory location accessible to the gaming machine;

obtaining player game configuration data, the data including one or more inputs of game characteristics desired by the player;

comparing the one or more inputs of game characteristics desired by the player with the pre-configured game parameters of the plurality of default games;

selecting, based on the comparison, one or more of the plurality of default games of different types having pre-configured game parameters most closely associated with the game characteristics desired by the player;

displaying a list of the selected default games on a display;

receiving an indication from a player representative of a chosen default game from the displayed list of selected default games;

receiving a wager from the player;

displaying a video image representative of the chosen default game;

executing the chosen default game according to the default configuration of the chosen default game;

determining a game outcome associated with the executed default game represented by the video image; and determining a value payout associated with the game outcome.

2. The method as recited in claim 1, wherein the memory location is remote to the video gaming machine.

3. The method as recited in claim 1, wherein the player game configuration data comprises at least one of a wagering denomination, a number of paylines, a frequency of payout, a jackpot size, a game theme, a bonus game, and a play speed.

4. The method as recited in claim 1, comprising grouping the player game configuration data.

5. The method as recited in claim 4, comprising grouping the player game configuration data into filtering configuration changes, substantive configuration changes, and cosmetic configuration changes.

6. The method as recited in claim 1, comprising receiving the player game configuration data from a player operating the video gaming machine.

7. The method as recited in claim 1, comprising receiving the player game configuration data from the memory device.

8. The method as recited in claim 1, comprising receiving the player game configuration data from the memory location.

9. The method as recited in claim 1, comprising saving a game configuration.

10. The method as recited in claim 9, comprising saving the game configuration in a memory storage space associated with the video gaming machine.

11. The method as recited in claim 9, comprising saving the game configuration on a recordable medium.

12. The method as recited in claim 9, comprising saving the game configuration in the memory location.

13. The method as recited in claim 1, comprising:

pre-configuring a video game before entering a gaming establishment where the video gaming machine is located; and storing the pre-configured video game in the central memory storage location.

14. The method as recited in claim 1, comprising:

tracking player game configurations at a gaming establishment where the video gaming machine is located;

recording the player game configurations; and suggesting one or more of the plurality of default games stored in memory most closely associated with the game configuration data and the recorded player game configurations.

15. The method as recited in claim 1, comprising configuring the chosen game according to the player game configuration data.

* * * * *